US009532407B2

(12) United States Patent
Viroli et al.

(10) Patent No.: US 9,532,407 B2
(45) Date of Patent: Dec. 27, 2016

(54) INDUCTION COOKING HOB WITH A NUMBER OF HEATING ZONES

(75) Inventors: Alex Viroli, Forli (IT); Svend Erik Christiansen, Forli (IT); Laurent Jeanneteau, Forli (IT); Luca Zannoni, Forli (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 538 days.

(21) Appl. No.: 13/994,949

(22) PCT Filed: Jan. 19, 2012

(86) PCT No.: PCT/EP2012/050794
§ 371 (c)(1),
(2), (4) Date: Jun. 17, 2013

(87) PCT Pub. No.: WO2012/098193
PCT Pub. Date: Jul. 26, 2012

(65) Prior Publication Data

US 2013/0284722 A1 Oct. 31, 2013

(30) Foreign Application Priority Data

Jan. 19, 2011 (EP) ..... 11000376

(51) Int. Cl.
*H05B 6/12* (2006.01)
*H05B 6/06* (2006.01)

(52) U.S. Cl.
CPC ..... *H05B 6/065* (2013.01)

(58) Field of Classification Search
CPC ..... H05B 6/065
(Continued)

(56) References Cited

U.S. PATENT DOCUMENTS 5,428,207 A * 6/1995 Essig ..... H05B 6/1254 219/622
6,828,530 B2 * 12/2004 Boegel ..... H05B 6/1218 219/506
(Continued)

FOREIGN PATENT DOCUMENTS

EP 2094060 8/2009
EP 2252130 11/2010
(Continued)

OTHER PUBLICATIONS

International Search Report for PCT/EP2012/050794, dated Apr. 16, 2012, 3 pages.

*Primary Examiner* — Dana Ross
*Assistant Examiner* — Joseph Iskra
(74) *Attorney, Agent, or Firm* — Pearne & Gordon LLP

(57) ABSTRACT

The present invention relates to an induction cooking hob (10) including a number of heating zones (12, 14, 16, 18). Each heating zone (12, 14, 16, 18) comprises or corresponds with at least one induction coil. Each induction coil is connected to a generator. Two or more heating zones (12, 14, 16, 18) are linked or can be linked into a cooking area by a user. The linked heating zones (12, 14, 16, 18) are controlled by a common power setting. An operator interface is provided for operating the heating zones (12, 14, 16, 18). A control unit is provided for controlling the heating zones (12, 14, 16, 18). The operator interface includes actuating elements corresponding with predetermined links (20) between the heating zones (12, 14, 16, 18). The control unit is provided for synchronizing the generators of the linked heating zones (12, 14, 16, 18) by one common controller.

20 Claims, 5 Drawing Sheets

Figure 1:
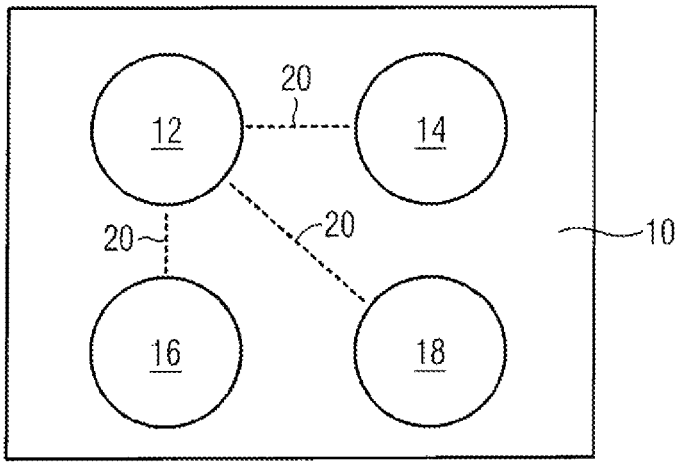

(58) Field of Classification Search
USPC ..... 426/520, 523, 665; 219/385, 443.1, 219/451.1, 452.11, 462.1, 482, 490, 494, 600, 219/618, 620, 621, 622, 625, 627
See application file for complete search history.

(56) References Cited

U.S. PATENT DOCUMENTS

| | | | | |
|---|---|---|---|---|
| 8,963,054 | B2 * | 2/2015 | Acero Acero | H05B 6/04 219/443.1 |
| 2006/0289489 | A1 * | 12/2006 | Wang | H05B 6/065 219/622 |
| 2009/0139980 | A1 * | 6/2009 | Acero Acero | H05B 6/04 219/489 |
| 2009/0212042 | A1 * | 8/2009 | Lee | H05B 6/1272 219/624 |
| 2011/0079591 | A1 * | 4/2011 | Parachini | H05B 6/065 219/620 |

FOREIGN PATENT DOCUMENTS

| | | |
|---|---|---|
| FR | 2758934 | 7/1998 |
| JP | 2009218042 | 9/2009 |

* cited by examiner

INDUCTION COOKING HOB WITH A NUMBER OF HEATING ZONES

The present invention relates to an induction cooking hob including a number of heating zones according to the preamble of claim 1.

The induction cooking hob typically includes a number of heating zones. Often two neighboured heating zones may be linked together in order to obtain a larger cooking area. For example, two neighboured circular heating zones are combined to a rectangular or oval cooking area provided for a corresponding rectangular or oval pot. The combined heating zones may be controlled with only one power setting. Usually, those heating zones, which can be combined to a larger cooking area, are predefined.

On a typical rectangular cooking hob, four heating zones form substantially a two-by-two matrix on said cooking hob. For example, the front and rear heating zones on the left hand side may be linked together. In a similar way, the front and rear heating zones on the right hand side may be linked together. Alternatively, the left and right front heating zones may be linked together, or the left and right rear heating zones may be linked together.

EP 2 094 060 A2 discloses an electric range and an induction coil unit used therein. The induction coil unit is arranged under a plate and includes a plurality of induction coils. At least one of the induction coils includes at least one rectilinear part. Thus, a part of the heating zones is not circular, but substantially rectangular or square. Further, diagonal heating zones may be linked.

The activation of the linked heating zones may be performed by the user, who activates separately the single heating zones.

The power of said single heating zones has to be set manually by the user. Acoustic noise can arise due to different frequencies of the generators for the induction coils.

Some cooking hobs have the feature of predetermined bridgeable zones. The user can link two neighboured heating zones and drive them by a single power setting. However, this concept is limited to the predetermined neighboured heating zones.

It is an object of the present invention to provide an induction cooking hob, which allows a more flexible combination of heating zones and avoids acoustic noise.

The object of the present invention is achieved by the induction cooking hob according to claim 1.

According to the present invention the operator interface includes actuating elements corresponding with predetermined links between the heating zones, and the control unit is provided for synchronizing the generators of the linked heating zones by one common controller.

The main idea of the present invention is the combination of the actuating elements for the predetermined links and the common controller for synchronizing the generators of the linked heating zones. The actuating elements allow a direct activation of the predetermined links by the user. The common controller allows a synchronization of the generators according to the selection of the user. Flexible combinations of linked heating zones can be easily selected by the user.

The use of one common controller allows an efficient and fast control of the linked heating zones. Since there is not any interconnection between the control devices of the different heating zones, the control unit can be realized by low complexity.

An exchange of information between different control devices is not required. In general, actuating elements may be provided for all possible combinations of heating zones.

According to a preferred embodiment of the present invention the common controller is provided for controlling the linked heating zones by a common power setting.

In particular, the common controller is provided for controlling the generators of the linked heating zones, so that the generators run at the same frequency. Thus, there is no noise due to different frequencies of the generators.

Preferably, the common controller is a microprocessor or a microcontroller. A microprocessor or a microcontroller are compact and reliable electronic circuits.

Further, the operator interface is preferably a touch pad. The touch pad gets no mechanical sign of wear.

In particular, the induction cooking hob includes a glass ceramic panel. In this case, the touch pad may be applied on the glass ceramic panel.

Moreover, the actuating elements corresponding with predetermined links may be labelled by symbols.

Furthermore, the heating zones may be arranged as a matrix on the induction cooking hob.

Preferably, the induction cooking hob comprises four heating zones. The four heating zones can be arranged in a half-circle around the operator interface. The rear heating zones can be arranged in parallel to the operator interface and/or the front heating zones can be arranged in parallel to the operator interface and/or the heating zones can be grouped into two pairs wherein each of the pairs can be arranged mutually inwardly inclined with the same or opposite inclination angle, especially with an inclination angle of 30° to 40° or of about 45°, with respect to the operator interface.

Preferably, the operator interface is made with touch-keys and display units, especially LED-indicators, for displaying the heating level of the heating zones.

Preferably, the operator interface comprises a main switch key and for each of the heating zones, two power level keys for controlling its power level, and a display unit, especially a 7-segment display, for displaying the current power level of the heating zone; with a first power level key to increase the power level and a second power level key to decrease the power level of the heating zone, wherein preferably the display unit is arranged in between the two power level keys.

Preferably, the actuating elements comprise at least three actuating keys for controlling the links between the heating zones, wherein preferably a first actuating key controls the link between the first and the second heating zone, wherein a second actuating key controls the link between the second and the third heating zone, wherein a third actuating key controls the link between the third and the fourth heating zone.

Preferably the actuating keys are arranged at the side, especially at the right side, of the operator interface.

Preferably, the heating level of each of the linked heating zones is controllable by the power level keys of the corresponding heating zones.

Preferably, the control unit comprises a first power module unit and a second power module unit, wherein preferably the first power module unit comprises two generators and the second power module unit comprises two generators, wherein preferably each of the generators comprises a half bridge inverter.

Preferably, the control unit comprises a power supply and an EMC filter unit.

Preferably, each of the generators supplies one of the induction coils with power and/or each generator drives one of the induction coils.

Preferably, each of the power module units comprises a bridge rectifier as a connection to a or the power supply and/or each of the generators is connected to the controller, especially the microcontroller, for controlling, wherein the second power module unit is preferably galvanically insulated from the controller, especially the microcontroller, by insulation means.

Preferably, between the rectifier of the first power module unit and the power supply, a current transformer is arranged.

Preferably, the power line of each power module unit comprises a measurement unit, especially a voltage measurement unit, which is able to measure amplitude, frequency and zero crossings of the input voltage.

Preferably, the controller, especially the microcontroller, is connected to the operator interface and/or the controller, especially the microcontroller, supplies the signals to drive the generators and receives as inputs the actual signals driving the induction coils, especially the current flowing in the coils. Preferably, a single controller, especially microcontroller, is driving the four generators.

Preferably, the control unit allows to supply the heating zones from two different phase lines of a three-phase supply, wherein each of the power lines of the power module units is connected with one of the different phase lines and/or preferably the control unit allows to supply the heating zones from a single phase supply wherein the power lines of the power module units are or can be connected with the same phase line.

Novel and inventive features of the present invention are set forth in the appended claims.

Figure 2:
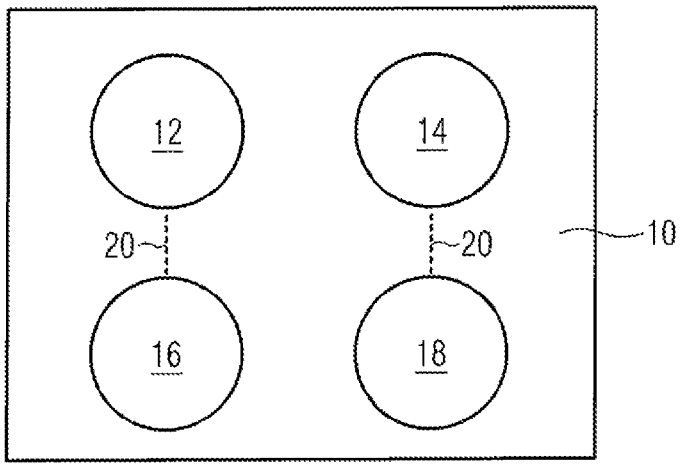
FIG 2 PRIOR ART
Figure 3:
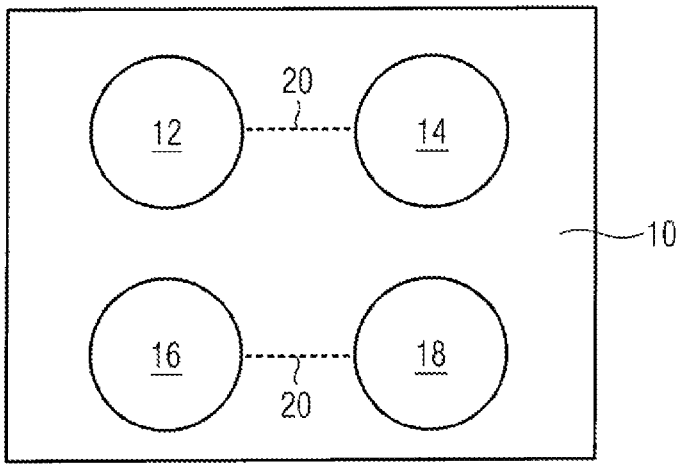
FIG 3 PRIOR ART
Figure 4:
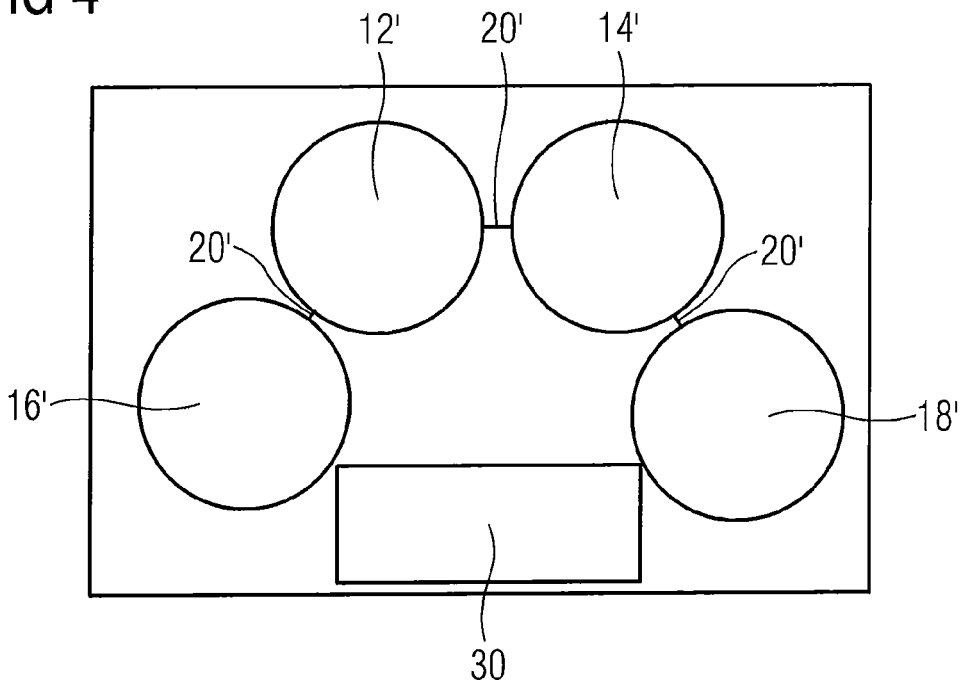
Figure 6:
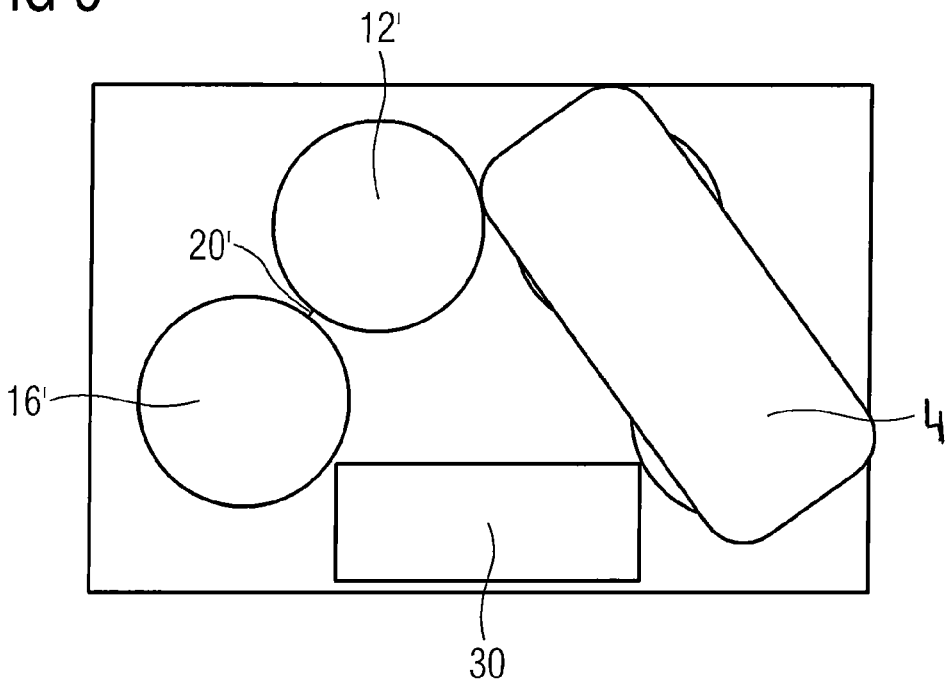
Figure 7:
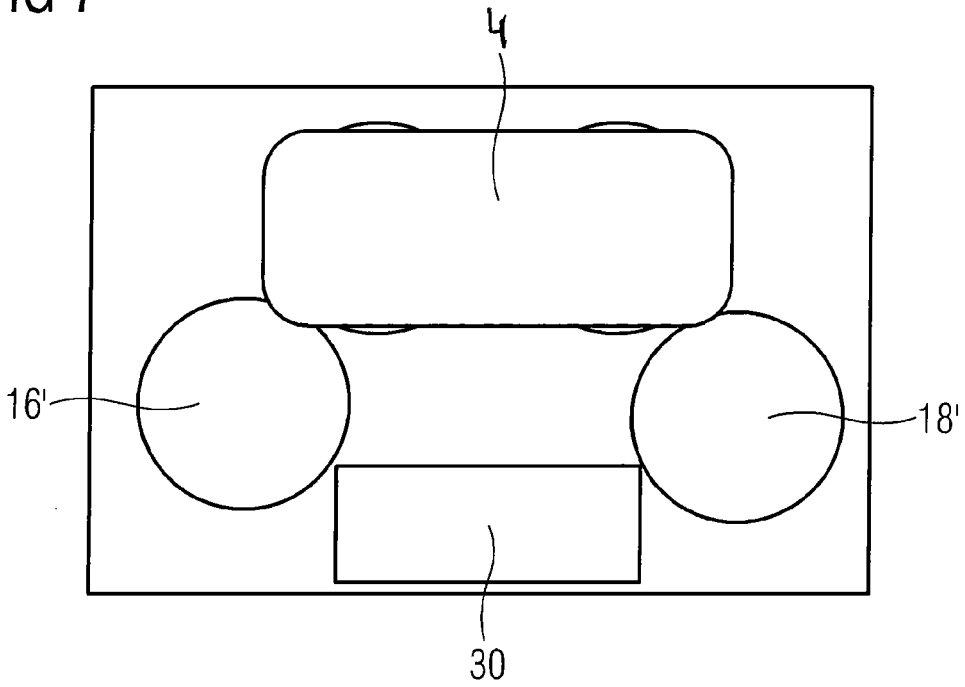
Figure 8:
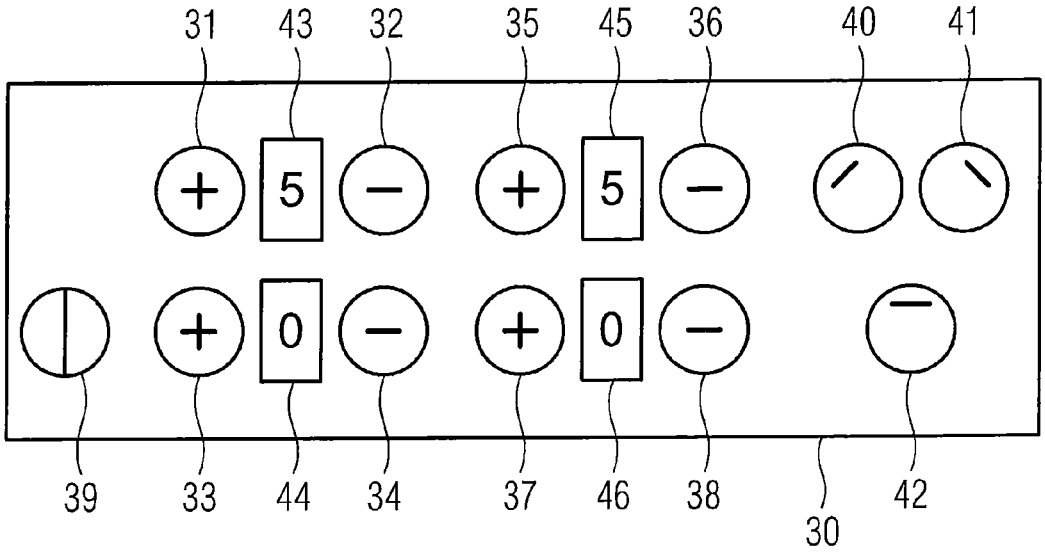
Figure 9:
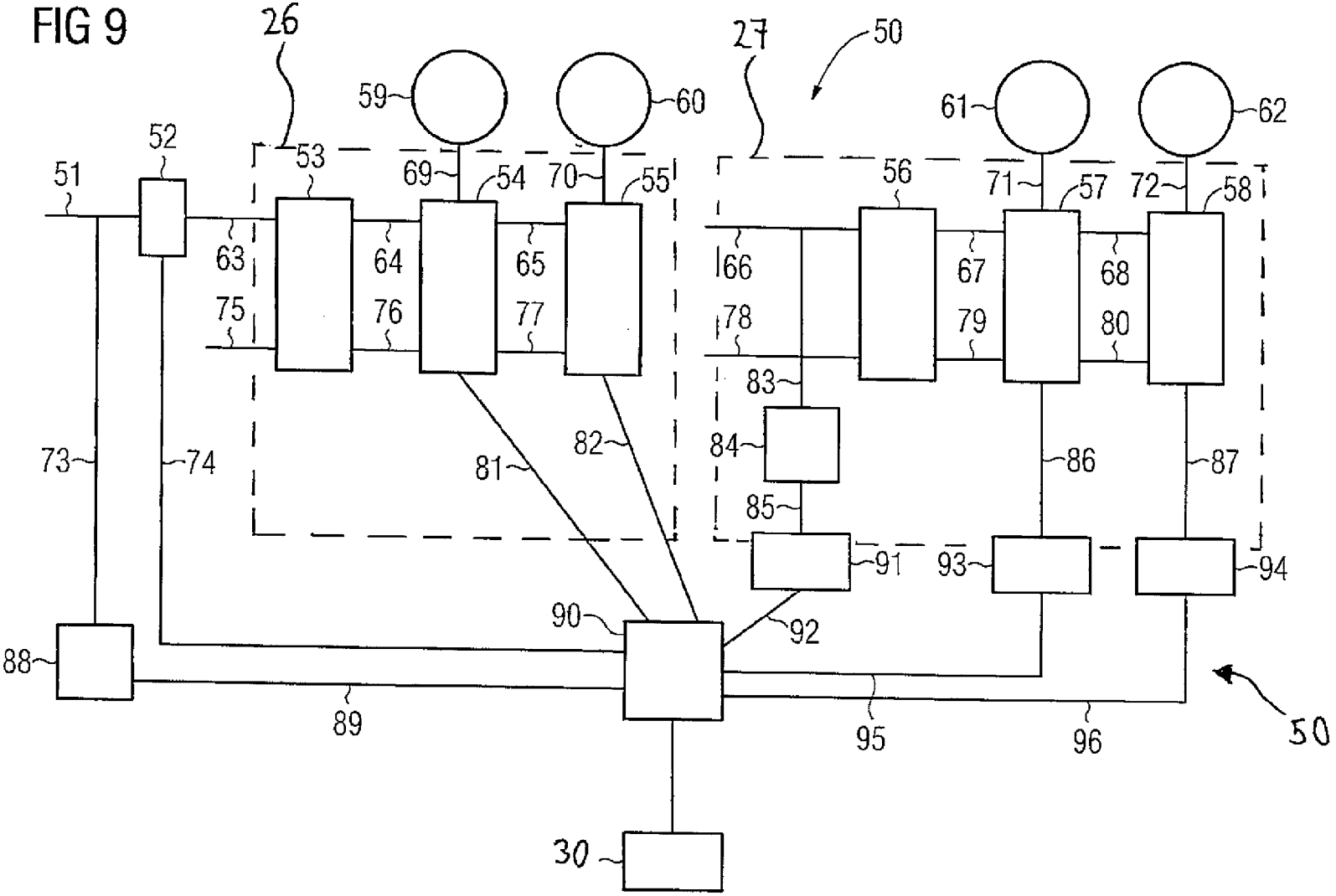

The present invention will be described in further detail with reference to the drawings, in which FIG. 1 illustrates a schematic top view of an induction cooking hob according to a preferred embodiment of the present invention, FIG. 2 illustrates a schematic top view of an example for the induction cooking hob according to the prior art, FIG. 3 illustrates a schematic top view of a further example for the induction cooking hob according to the prior art, FIG. 4 to FIG. 7 show a top view of a further induction cooking hob according to a further preferred embodiment of the present invention, FIG. 8 shows the user interface according to the invention and FIG. 9 shows a schematic of the electric circuit according to the invention.

FIG. 1 illustrates a schematic top view of an induction cooking hob 10 according to a preferred embodiment of the present invention. In this example, the induction cooking hob 10 includes four heating zones 12, 14, 16 and 18. In general, the induction cooking hob 10 may comprise an arbitrary number of heating zones.

A first heating zone 12 is arranged on the rear portion of left hand side of the cooking hob 10. A second heating zone 14 is arranged on the rear portion of right hand side of the cooking hob 10. A third heating zone 16 is arranged on the front portion of left hand side of the cooking hob 10. A fourth heating zone 18 is arranged on the front portion of right hand side of the cooking hob 10.

The first heating zone 12 can be combined with the second heating zone 14, the third heating zone 16 and/or the fourth heating zone 18 to a larger cooking area. Possible links 20 between the heating zones 12, 14, 16 and 18 are represented by dashed lines.

In FIG. 1 only three links 20 between the heating zones 12, 14, 16 and 18 are shown. In general, the links 20 are provided between each pair of neighboured heating zones 12, 14, 16 and 18.

The arrangement of the four heating zones 12, 14, 16 and 18 on the induction cooking hob 10 forms substantially a two-by-two matrix. Alternative arrangements of the heating zones 12, 14, 16 and 18 on the induction cooking hob 10 are also possible.

Each heating zone 12, 14, 16 and 18 comprises at least one induction coil. Each induction coil is connected to a generator. The induction coils and the generators are not explicitly shown in FIG. 1.

Further, the induction cooking hob 10 comprises an operator interface and a control unit, which are not shown in FIG. 1. Said operator interface includes a plurality of actuating elements. In addition to the conventional actuating elements provided for switching the single heating zone 12, 14, 16 and 18, the operator interface includes further actuating elements for activating the links 20 between the heating zones 12, 14, 16 and 18. The links 20 between the heating zones 12, 14, 16 and 18 are predetermined. Each of said predetermined links 20 corresponds with one actuating element, so that the user can directly activate the selected link 20.

The control unit is provided for controlling the generators for the induction coils by one single controller. The generators for the linked heating zones 12, 14, 16 and/or 18 run at the same frequency, so that no acoustic noise arises.

Preferably, the common controller is a microprocessor. If the generators are controlled by a single controller or microprocessor, respectively, then the generators for the linked heating zones 12, 14, 16 and/or 18 can run at the same frequency. In particular, when the frequency has to be changed due to a power regulation, then the generators can always run at the same frequency.

FIG. 2 illustrates a schematic top view of an example for the induction cooking hob 10 according to the prior art. The induction cooking hob 10 of the prior art includes also four heating zones 12, 14, 16 and 18.

The first heating zone 12 and the third heating zone 16 are linked together. These are the rear and front heating zones, respectively, on the left hand side of the cooking hob 10. In a similar way, the second heating zone 14 and the fourth heating zone 16 are linked together. Those are the rear and front heating zones, respectively, on the right hand side of the cooking hob 10. Any further links 20 between the heating zones 12, 14, 16 and 18 are not provided.

FIG. 3 illustrates a schematic top view of a further example for the induction cooking 10 hob according to the prior art. The induction cooking hob 10 of the prior art also includes four heating zones 12, 14, 16 and 18.

The first heating zone 12 and the second heating zone 14 are linked together. These are the rear heating zones on the left hand side and right hand side, respectively, of the cooking hob 10. In a similar way, the third heating zone 16 and the fourth heating zone 16 are linked together. Those are the front heating zones on the left hand side and right hand side, respectively, of the cooking hob 10. Any further links 20 between the heating zones 12, 14, 16 and 18 are not provided.

Figure 5:
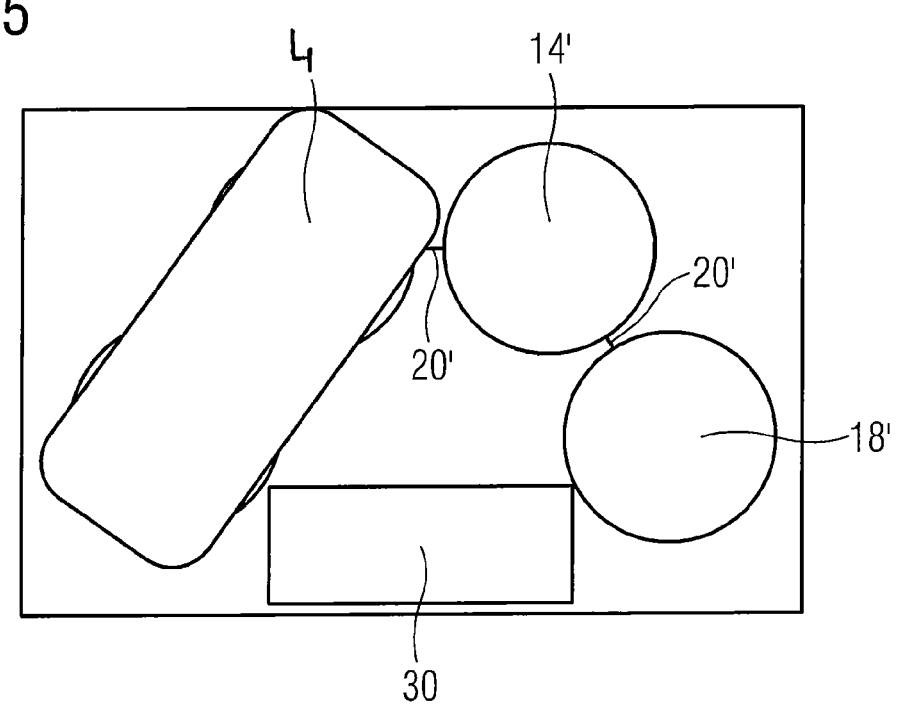

FIGS. 4 to 7 show an example of an induction cooking hob according to the invention with flexible cooking zones or heating zones whereas, in FIGS. 5 to 7, a pot 4 is arranged on the cooking hob in different positions.

In the embodiment, four heating zones 16', 12', 14' and 18' are arranged in a half-circle around the operator interface 30. The rear heating zones 12' and 14' are arranged in parallel to the operator interface 30. Similarly, the front heating zones 16' and 18' are arranged in parallel to the operator interface 30.

The heating zones 16' and 12' on the one hand and the heating zones 14' and 18' on the other hand are arranged mutually inclined, preferably each with an angle between 30° and 40° or of about 45°, with respect to the operator interface 30.

FIGS. 5 to 7 show a pot 4 which is covering the heating zones 16' and 12'. In FIG. 5, the pot 4 covers the heating zones 16' and 12'. In FIG. 6, the pot 4 covers the heating zones 14' and 18'. In FIG. 7, the pot 4 covers the heating zones 12' and 14'.

FIG. 8 shows in detail the operator interface 30 which can be rectangular and can be made with touch-keys and/or LED indicators. The operator interface comprises a main switch key 39 and for each of the heating zones, +/− keys as power level keys to change its power level and a 7-segment display to show the heating level.

Therefore, the "+"-key 31 acts as first power level key for increasing the power level and the "−"-key 32 as second power level key for decreasing the power level of the heating zone 12'. The LED indicator 43 displays the current heating level of the heating zone 12'.

The "+"-key 33 acts as first power level key for increasing the power level and the "−"-key 34 as second power level key for decreasing the power level of the heating zone 16'. The LED indicator 44 displays the heating level of the heating zone 16'.

The "+"-key 35 acts as first power level key for increasing the power level and the "−"-key 36 as second power level key for decreasing the power level of the heating zone 14'. The LED indicator 45 displays the heating level of the heating zone 14'.

The "+"-key 37 acts as first power level key for increasing the power level and the "−"-key 38 as second power level key for decreasing the power level of the heating zone 18'. The LED indicator 46 displays the heating level of the heating zone 18'.

The "+/−"-keys for each heating zone are arranged besides each other whereas in between the "+/−"-keys the 7-segment display to show the power level of the heating zone is arranged.

Furthermore, three keys 40, 41 and 42 are arranged at the right side of the operator interface to set which two heating zones shall be linked together: left zones 12', 16', right zones 14', 18' or rear zones 12', 14'. Therefore, key 40 links heating zones 16' and 12'. Key 41 links the heating zones 14' and 18'. Key 42 links the heating zones 12' and 14'.

When two heating zones are linked together, they can be controlled by one of the power level keys ("+/−"-keys) of one of the corresponding heating zones.

FIG. 9 shows a simplified schematic view of the induction module or control unit 50 which controls the flexible heating zones.

The induction module or control unit 50 comprises a first power module unit 26 and a second power module unit 27, wherein the first power module unit comprises two generators 54 and 55 and the second power module unit comprises two generators 57 and 58. The generators 54, 55, 57 and 58 can be implemented by half bridge inverters.

Each of the generators supplies one of the induction coils 59, 60, 61 and 62.

Each of the power module units 26, 27 comprises a bridge rectifier as a connection to the power supply. The reference signs 53 and 56 denote the bridge rectifiers.

Each of the generators 54, 55, 57, 58 is connected to the microcontroller 90 for controlling, wherein the generators 57, 58 of the second power module unit 27 are galvanically insulated from the microcontroller 90 by insulation means. The reference signs 91, 93 and 94 denote the insulations means, which are responsible for galvanic insulation of the second power module unit 27.

Between the rectifier 53 of the first power module unit 26 and the power supply, a current transformer 52 is arranged.

The power line 51, 66 of each power module unit 26, 27 comprises a voltage measurement unit 88, 84 which is able to measure amplitude, frequency and zero crossings of the input voltage. The parts 88 and 84 comprise measurement units on input voltage for amplitude, frequency and zero crossing.

The microcontroller 90 is connected to the operator interface 30. The microcontroller 90 supplies the signals to drive the generators 54, 55, 57, 58 and receives as inputs the relevant signals to drive the induction coils 59 to 62, like the current flowing in the induction coil. A single microcontroller 90 is driving four generators 54, 55, 57 and 58.

The control unit 50 allows to supply the heating zones from two phases of a three-phase supply. In this case, each of the power lines 51 and 66 of one of the two power module units 26, 27 is connected with the one of the two phases. The connections 51 and 66 in this case denote the phases L1 and L2 which can therefore be two phases from a three-phase main supply. The neutral pole N is denoted by the reference signs 75 and 78.

The control unit 50 also allows to supply the heating zones from a single phase supply. In this case, the power lines 51 and 66 can be both connected together with the phase line of the power supply.

The control unit 50 preferably further comprises a power supply and EMC filters, which are not shown in the simplified view of FIG. 9.

The power line 51 is connected with the current transformer 52. The current transformer 52 is connected by a line 74 to the microcontroller 90 and by a line 63 to the rectifier 53.

The rectifier 53 is connected by a line 64 and the neutral line 76 to the power module 54. The rectifier 56 is connected by a line 67 and the neutral line 79 to the power module 57.

The generator 54 is connected by the lines 65 and 77 to the generator 55. The generator 57 is connected by the lines 68 and 80 to the generator 58.

Generator 54 is connected by connection 69 to the coil 59. Generator 55 is connected by connection 70 to the coil 60. Generator 57 is connected by connection 71 to the coil 61. Generator 58 is connected by connection 72 to the coil 62.

Generator 54 is connected by a connection 81 to the microcontroller 90. Generator 55 is connected by a connection 82 to the microcontroller 90.

Generator 57 is connected by a connection 86 to the insulation 93 and from there by a connection 95 to the microcontroller 90. Generator 58 is connected by a connection 87 to the insulation 94 and from there by a connection 96 to the microcontroller 90.

The power line 51 is connected by a line 73 to the measurement unit 88. The measurement unit 88 is connected to the microcontroller 90 by a connection 89. The current transformer 52 is connected to the micro controller 90 by the connection 74.

The power line 66 is connected by a line 83 to the measurement unit 84. The measurement unit 84 is connected by a line 85 to the insulation means 91. The insulation means 91 is connected by connection 92 to the microcontroller 90.

LIST OF REFERENCE NUMERALS

4 pot
10 cooking hob
12, 12' first heating zone
14, 14' second heating zone
16, 16' third heating zone
18, 18' fourth heating zone
20, 20' link
31, 33, 35, 37 first power level key ("+"-key)
32, 34, 36, 38 second power level key ("–"-key)
30 operator interface
39 main switch key
26 first power module unit
27 second power module unit
40 to 42 actuating keys
43 to 46 display unit
50 control unit
51, 66 power lines
52 current transformer
54, 55, 57, 58 generators
59, 60, 61, 62 induction coils (C1 to C4)
53, 56 bridge rectifiers
63, 65 connections
67 to 74, 77 connections
75, 78 neutral pole
79, 80, 83 connections
86, 87 connections
88, 84 measurement units
90 microcontroller
91, 93, 94 insulations means
89, 92, 95, 96 connections

The invention claimed is:

1. An induction cooking hob (10) including a number of heating zones (12, 12'; 14, 14'; 16, 16'; 18, 18'), wherein:

each heating zone (12, 12'; 14, 14'; 16, 16'; 18, 18') comprises or corresponds with at least one induction coil, each induction coil is connected to a separate generator, two or more heating zones (12, 12'; 14, 14'; 16, 16'; 18, 18') are configured to be linked into a cooking area by a user via an operator interface including actuating elements corresponding with predetermined links (20, 20') between the heating zones (12, 12'; 14, 14'; 16, 16'; 18, 18'), the linked heating zones (12, 12'; 14, 14'; 16, 16'; 18, 18') are controlled by a common power setting, and a control unit is provided for controlling the heating zones (12, 12'; 14, 14'; 16, 16'; 18, 18') and for synchronizing the generators of the linked heating zones (12, 12'; 14, 14'; 16, 16'; 18, 18') by one common controller, wherein the common controller controls the generators of the linked heating zones (12, 12'; 14, 14'; 16, 16'; 18, 18'), so that the generators run at the same frequency.

2. The induction cooking hob according to claim 1, characterized in, that the common controller is provided for controlling the linked heating zones (12, 12'; 14, 14'; 16, 16'; 18, 18') by a common power setting.

3. The induction cooking hob according to claim 1 characterized in, that the common controller is a microprocessor or a microcontroller and that the operator interface is a touch pad.

4. The induction cooking hob according to claim 1, characterized in, that the induction cooking hob (10) includes a glass ceramic panel, wherein the touch pad is applied on the glass ceramic panel.

5. The induction cooking hob according to claim 1, characterized in, that the actuating elements corresponding with predetermined links (20, 20') are labelled by symbols.

6. The induction cooking hob according to claim 1, characterized in, that the heating zones (12, 12'; 14, 14'; 16, 16'; 18, 18') are arranged as a matrix on the induction cooking hob (10).

7. The induction cooking hob according to claim 1, characterized in, that it comprises four heating zones wherein the four heating zones (16', 12', 14', 18') are arranged in a half-circle around the operator interface (30) wherein the rear heating zones (12', 14') are arranged in parallel to the operator interface (30), the front heating zones (16', 18') are arranged in parallel to the operator interface (30), and the heating zones (16', 12', 14', 18') are arranged mutually inclined with respect to the operator interface 30.

8. The induction cooking hob according to claim 1, characterized in, that the operator interface (30) is made with touch-keys and display units for displaying the heating level of the heating zone (12'), wherein the operator interface (30) comprises a main switch key (39) and for each of the heating zones, two power level keys for controlling its power level, and a display unit (43 to 46) for displaying the current power level; with a first power level key (31, 33, 35, 37) to increase the power level and a second power level key (32, 34, 36, 38) to decrease the power level, wherein the display unit is arranged in between the two power level keys.

9. The induction cooking hob according to claim 1, characterized in, that the actuating elements comprise at least three actuating keys (40, 41, 42) for controlling the links (20') between the heating zones, wherein a first actuating key (40) controls the link between the first and the second heating zone (12', 16'), wherein a second actuating key (41) controls the link between the second and the third heating zone (12', 16'), wherein a third actuating key (42) controls the link between the third and the fourth heating zone (12', 16'), wherein the actuating keys are arranged at the side of the operator interface (30), wherein the heating level of each of the linked heating zones is controllable by the power level keys of the corresponding heating zones.

10. The induction cooking hob according to claim 1, characterized in, that the control unit (50) comprises a first power module unit (26) and a second power module unit (27), wherein the first power module unit comprises two generators (54, 55) and the second power module unit comprises two generators (57, 58), wherein each of the power module units comprises a half bridge inverter and the control unit (50) comprises a power supply and an EMC filter unit.

11. The induction cooking hob according to claim 1, characterized in, that each of the generators supplies one of the induction coils (59, 60, 61, 62) and each generator drives one of the induction coils (59 to 62).

12. The induction cooking hob according to claim 1, characterized in, that each of the power module units (26, 27) comprises a bridge rectifier (53, 56) as a connection to a power supply and each of the generators (54, 55, 57, 58) is connected to the controller (90) for controlling, wherein the second power module unit (27) is galvanically insulated from the controller (90) by insulation means (91, 93, 94).

13. The induction cooking hob according to claim 1, characterized in, that between the rectifier (53) of the first power module unit (26) and the power supply, a current transformer (52) is arranged and in that the power line (63, 66) of each power module unit (26, 27) comprises a measurement unit (88, 84) which is able to measure amplitude, frequency, voltage, or zero crossings of the input voltage.

14. The induction cooking hob according to claim 1, characterized in, that the controller (90) is connected to the operator interface (30) and the controller (90) supplies the signals to drive the generators (54, 55, 57, 58) and receives as inputs the actual signals driving the induction coils (59 to 62) and a single controller (90) is driving the four generators (54, 55, 57, 58).

15. The induction cooking hob according to claim 1, characterized in, that the control unit (50) allows to supply the heating zones (12', 14', 16', 18') from two different phases of a three-phase supply, wherein each of the two different phases is connected with the power line (51, 66) of one of the power module units (26, 27) and the control unit (50) allows to supply the heating zones (12', 14', 16', 18') from a single phase supply wherein the power line (51, 66) of each of the power module units is configured to be connected with the same phase.

16. The induction cooking hob according to claim 7, wherein the heating zones (16', 12', 14', 18') are arranged mutually inclined with an angle of about 45° with respect to the operator interface 30.

17. The induction cooking hob according to claim 8, wherein the touch-keys and display units are LED indicators.

18. The induction cooking hob according to claim 8, wherein the display unit (43 to 46) is a 7-segment LED-display.

19. The induction cooking hob according to claim 9, wherein the actuating keys are arranged at the right side of the operator interface (30).

20. The induction cooking hob according to claim 1, wherein the generators of the linked heating zones (12, 12'; 14, 14'; 16, 16'; 18, 18') always run at the same frequency.

* * * * *